United States Patent [19]

Wu

[11] 4,222,557

[45] Sep. 16, 1980

[54] PRINTER FEEDING AND STACKING

[75] Inventor: Edward S. Wu, Chelmsford, Mass.

[73] Assignee: Wang Laboratories, Inc., Lowell, Mass.

[21] Appl. No.: 906,581

[22] Filed: May 16, 1978

[51] Int. Cl.[3] ..... B65H 3/44; B65H 1/12; B65H 1/28; B65H 3/06

[52] U.S. Cl. ..... 271/4; 271/9; 271/117; 271/126; 271/149; 271/178; 400/625; 400/629

[58] Field of Search ..... 271/4, 9, 126, 127, 271/149, 150, 162, 163, 164, 178, 177, 80, 160, 117, 118; 400/624, 625, 629; 414/123, 129, 330, 112; 221/123, 281

[56] References Cited

U.S. PATENT DOCUMENTS

| | | | |
|---|---|---|---|
| 3,756,586 | 9/1973 | Craft | 271/9 |
| 4,084,805 | 4/1978 | Simpson | 271/4 |

FOREIGN PATENT DOCUMENTS

| | | | |
|---|---|---|---|
| 419574 | 10/1923 | Fed. Rep. of Germany | 271/160 |
| 28191 | of 1909 | United Kingdom | 400/629 |

*Primary Examiner*—Bruce H. Stoner, Jr.

[57] ABSTRACT

A printer feeding and stacking mechanism for feeding a printer selectively with individual sheets of paper from one of two feeding hoppers holding stacks of individual sheets and sequentially depositing the typed sheets in a stacking hopper. The device features a selectively operable feeding mechanism mounted between the two feeding hoppers; mechanism for moving the feeding hopper walls between operating and loading positions; and mechanism for sequentially stacking the printed sheets into the stacking hopper.

17 Claims, 9 Drawing Figures

FIG 4
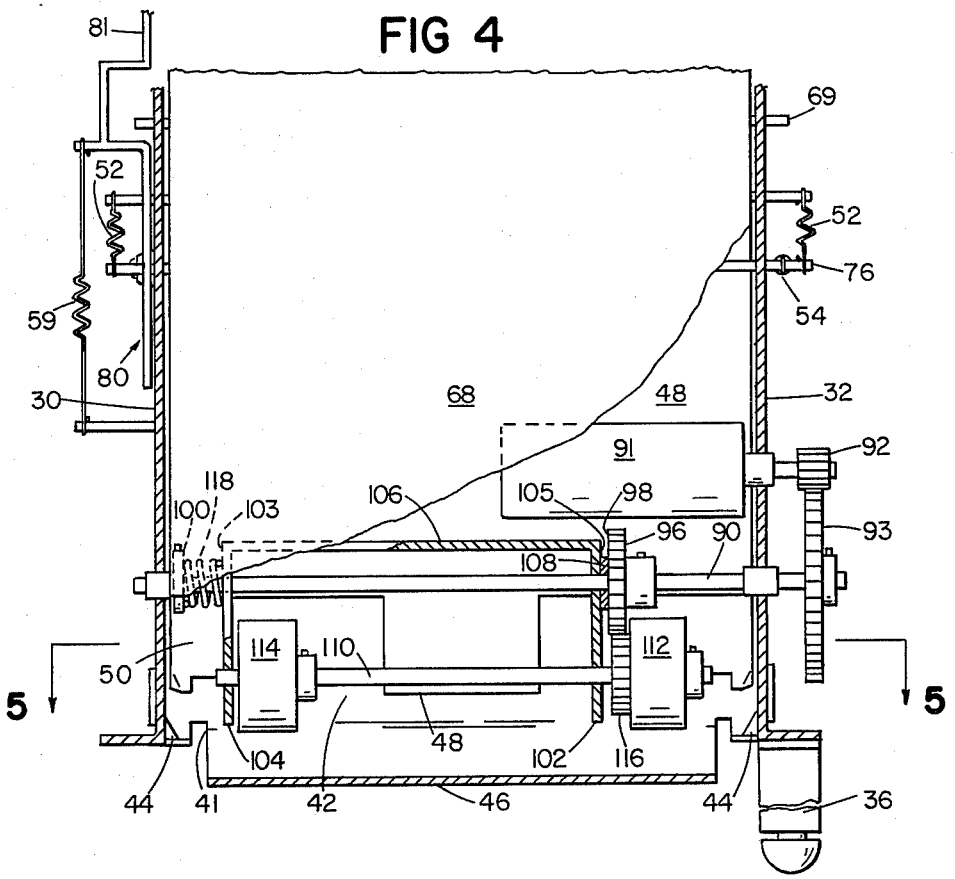
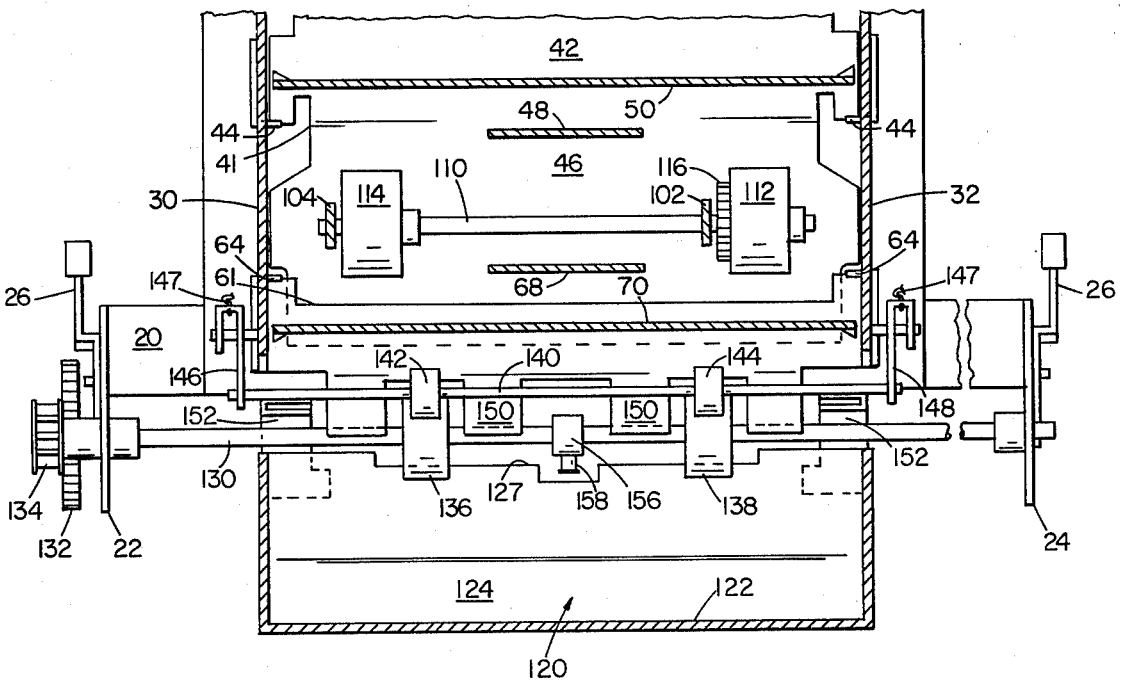
FIG 5

PRINTER FEEDING AND STACKING

This invention relates to printers and more particularly to individual sheet feeding and stacking mechanisms therefor.

The advent of word processing systems employing high speed output printers has created a need for individual sheet feeding and stacking mechanisms, not only to save operator time, but also to reduce the down time of the relatively expensive word processing system and so increase its efficiency. A number of such mechanisms are presently available, but are deficient in that they are unable to feed from more than a single source, so that, for example, they cannot be used to feed a printer producing a two page letter in which the first page has a letterhead and the second page is blank. Another deficiency with the sheet feeders available in the market is that when a stack of paper is retrieved from the stacker, the sequence is reversed, with the printed side of the last page on the top of the stack.

Accordingly, it is a major object of the present invention to provide a novel dual sheet feeder capable of selecting an individual sheet from either one of two stacks of sheets and feeding it to a printer.

It is another object of the invention to provide novel mechanisms facilitating the loading of a stack of sheets into a printer feeder.

It is still another object of the invention to provide novel stacking mechanisms for sequentially stacking individual sheets delivered from a printer.

The above and still further objects of the present invention, in one aspect thereof, are provided by a dual sheet feeder for a printer or the like with a supporting frame having mounted thereon a pair of opposed sheet hoppers for supporting opposed stacks of paper sheets and extracting means mounted on the frame between the hoppers for selectively extracting sheets from either of the hoppers. The extracting means has a drive shaft mounted on the frame between the hoppers for rotation about an axis parallel to them and reversible power means for selectively rotating the drive shaft in opposite directions. It also has rocker arm means rockably mounted on the drive shaft, sheet engaging roll means rotatably mounted on the rocker arm means for rotation about an axis spaced from and parallel to the drive shaft axis and sheet engaging roll driving means mounted on the drive shaft for rotating the sheet engaging roll means. Friction means are interposed between the arm means and the drive shaft for rocking the arm means in the direction of rotation of the drive shaft to selectively engage the sheet engaging roll means with one of the opposed stacks of paper sheets and extract an individual sheet therefrom.

In another aspect, the present invention provides a sheet feeder for a printer or the like comprising a supporting frame, a sheet feeding hopper mounted on the frame for supporting a stack of paper sheets and extracting means mounted on the frame for extracting individual sheets from the hopper. The sheet feeding hopper has bottom wall means for supporting thereon the bottom edge of a stack of paper sheets. Its inner edge is adjacent the extracting means and its outer edge is remote from the extracting means. A generally vertical inner wall means is mounted for generally horizontal movement of its lower edge from an operating position adjacent the inner edge of the bottom wall means to a loading position more remote from that inner edge. A generally vertical outer wall means is provided horizontally spaced from the inner wall means and mounted on the frame for generally horizontal movement of its lower edge from an operating position outward of the inner wall means to a loading position more remote from the inner wall means. Positioning means, preferably including cam means pivotally mounted on the frame and follower means mounted on the inner and outer wall means, are provided for moving the wall means between their inner and outer positions.

In a third aspect, the present invention provides a novel sheet stacker for a printer or the like, comprising a supporting frame, a sheet receiving hopper having a side wall and a bottom end wall extending rearwardly therefrom and stacking means for feeding individual sheets into the hopper. The stacking means comprises nip roll means adjacent the rear edge of the bottom end wall of the sheet receiving hopper, the nip roll means including tangentially contacting roll surfaces for feeding individual sheets therebetween, and pusher means for engaging the trailing edge of a paper sheet, preferably after it passes the tangentially contacting roll surfaces, for feeding it into the stacking hopper.

For the purpose of more fully explaining the above and still further objects and features of the invention, reference is now made to the following detailed description of a preferred embodiment thereof, together with the accompanying drawings, wherein:

FIG. 4 is a vertical sectional front view of the mechanism of FIG. 1, taken on line 4—4 of FIGS. 2 and 3;

FIG. 5 is a horizontal sectional top view of the mechanism of FIG. 1, taken on line 5—5 of FIG. 4;

Figure 1:
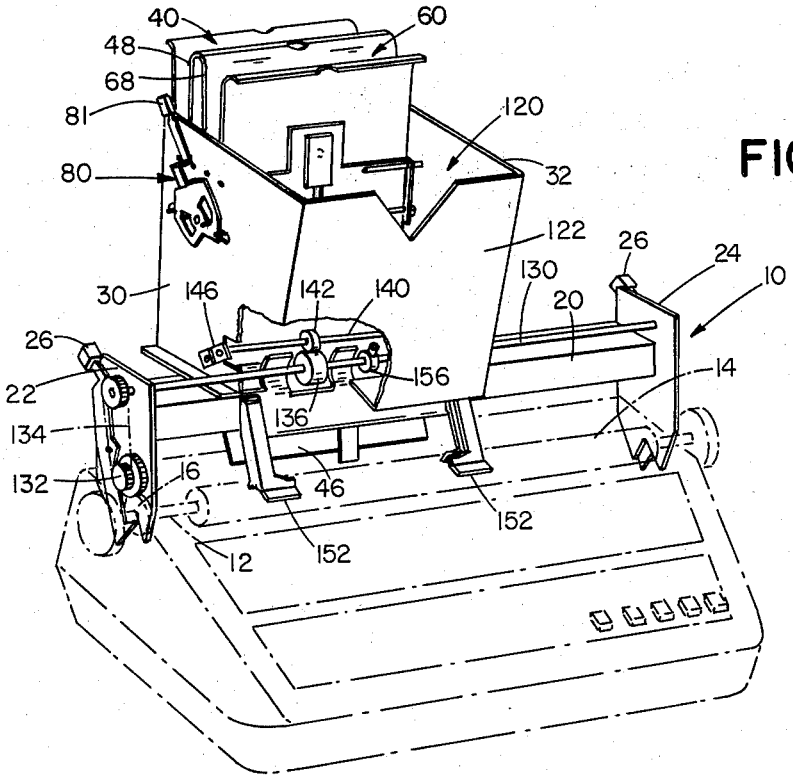
FIG. 1 is an isometric view of a dual sheet feeding and stacking mechanism according to the present invention mounted on a printer.
Figure 6:
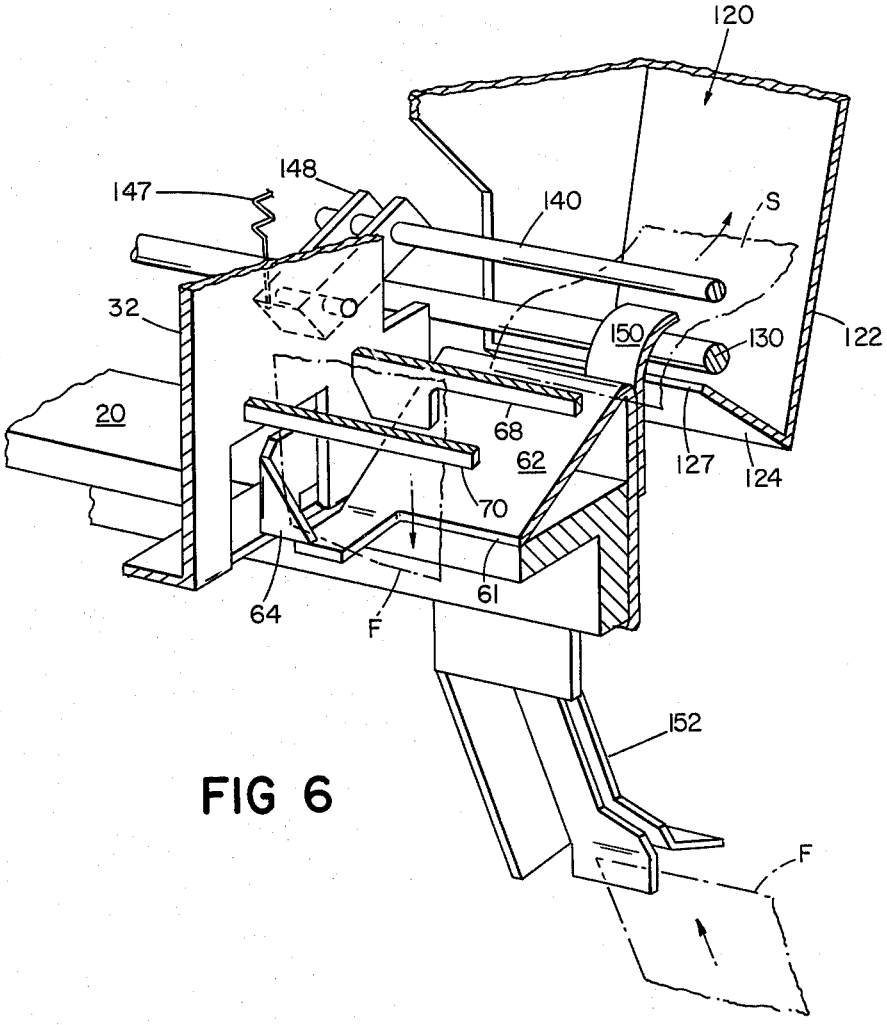
FIG. 6 is an isometric detail view of a portion of the mechanism of FIG. 1.
Figure 3:
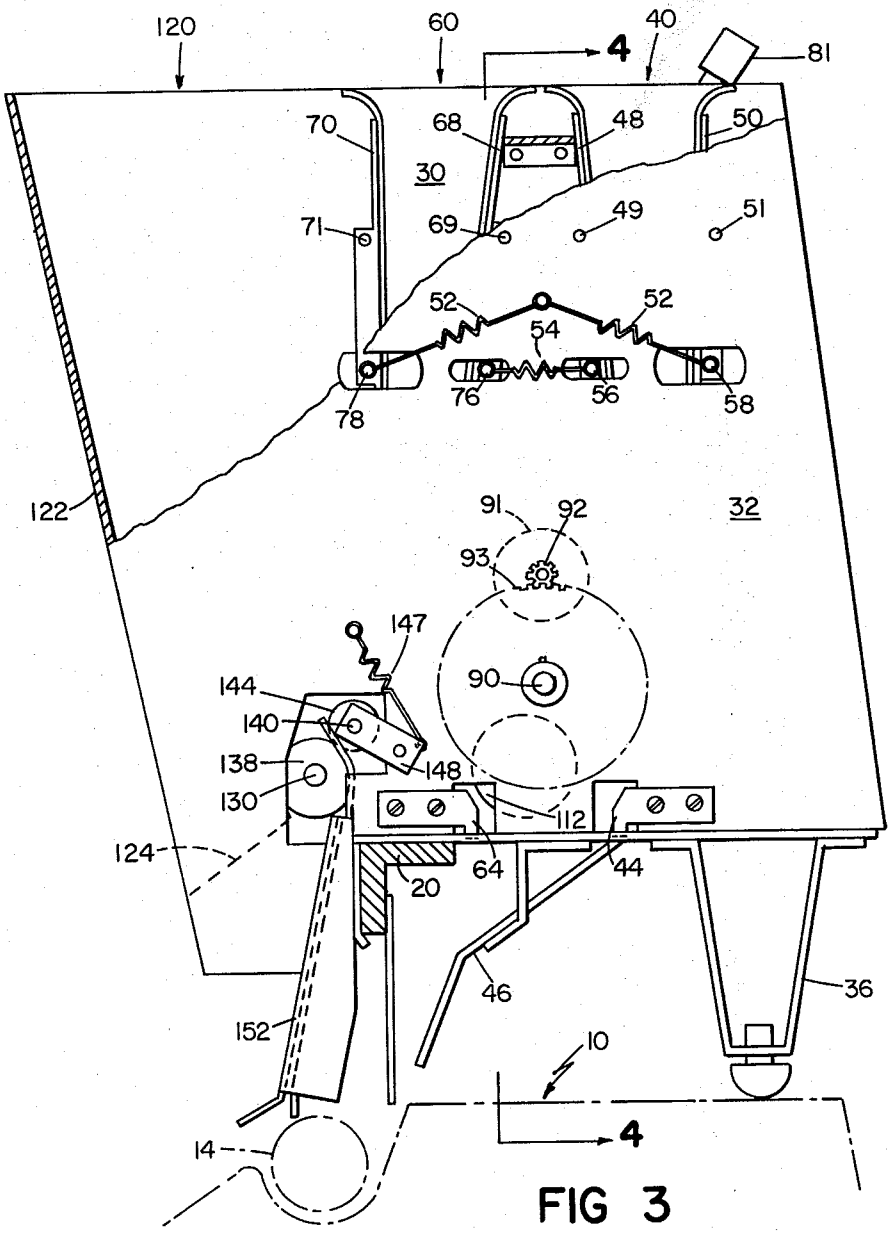
FIG. 3 is an opposite end view, partly broken away, of the mechanism of FIG. 1.
Figure 9:
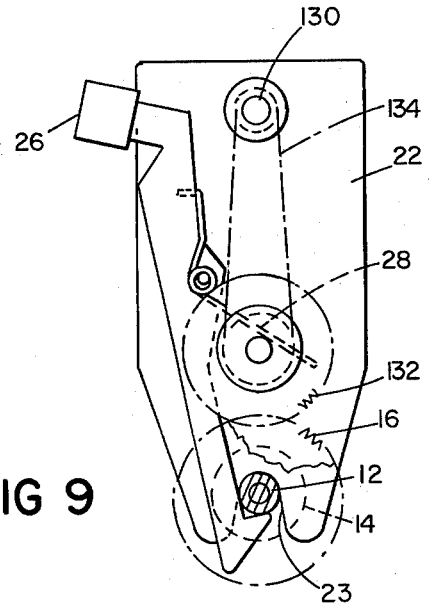

Referring to the drawings, the dual sheet feeding and stacking mechanism of the preferred embodiment of the invention is shown removably mounted on a printer 10. The mechanism has a supporting frame including a transversely extending base support member 20 having end support plates 22 and 24 mounted on its ends. Each of end support plates 22 and 24, as best shown in FIGS. 1 and 9, has a downwardly facing semicircular notch 23 for receiving platen shaft 12 of printer 10 and a manually operable latch arm 26 pivotally mounted thereon and normally urged into latching position beneath platen shaft 12 by its spring 28 for removably retaining the dual feeding and stacking mechanism of the invention in operating position on platen shaft 12 of printer 10.

According to the present invention, the dual sheet feeder mechanism of the present invention has a pair of opposed sheet feeding hoppers, generally designated 40 and 60, for supporting opposed stacks of paper sheets for selective extraction therefrom as hereinafter more fully explained.

Hoppers 40 and 60, as best shown in FIGS. 1, 2, 5 and 6, extend between a pair of transversely spaced vertical side plates 30 and 32 mounted on base support member 20. Side plate 30 has mounted thereon a downwardly extending supporting foot 36 which rests on the cover of printer 10. Each hopper has a bottom wall for supporting thereon the bottom edge of a stack of paper sheets and a pair of generally vertical walls extending between side plates 30 and 32 and pivotally mounted thereon for supporting the sides of said stack. The opposed inner walls of hoppers 40 and 60 are spaced from one another with the extracting mechanism mounted therebetween for selectively extracting individual sheets from either of the hoppers, as hereinafter more fully explained.

Figure 7:
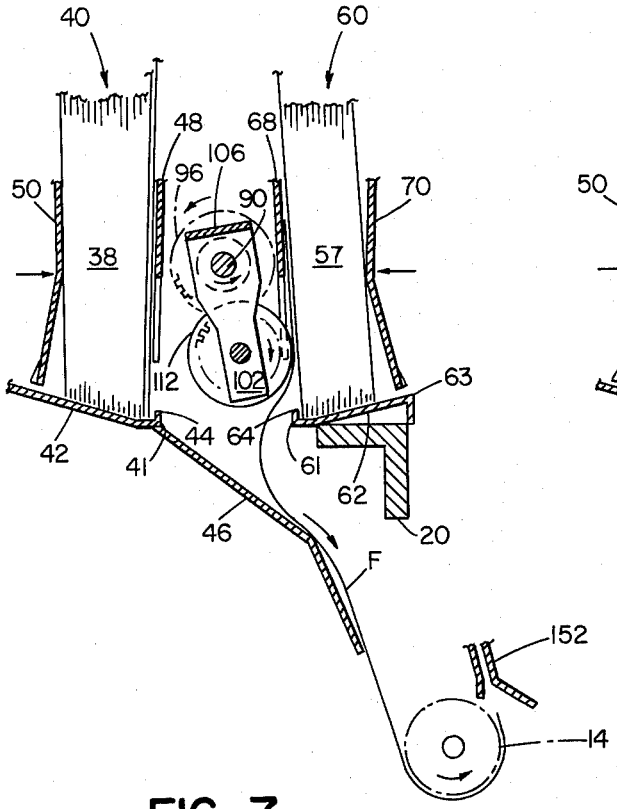
FIGS. 7, 8 and 9 are detail sectional views of portions of the mechanism of FIG. 1.
Figure 8:
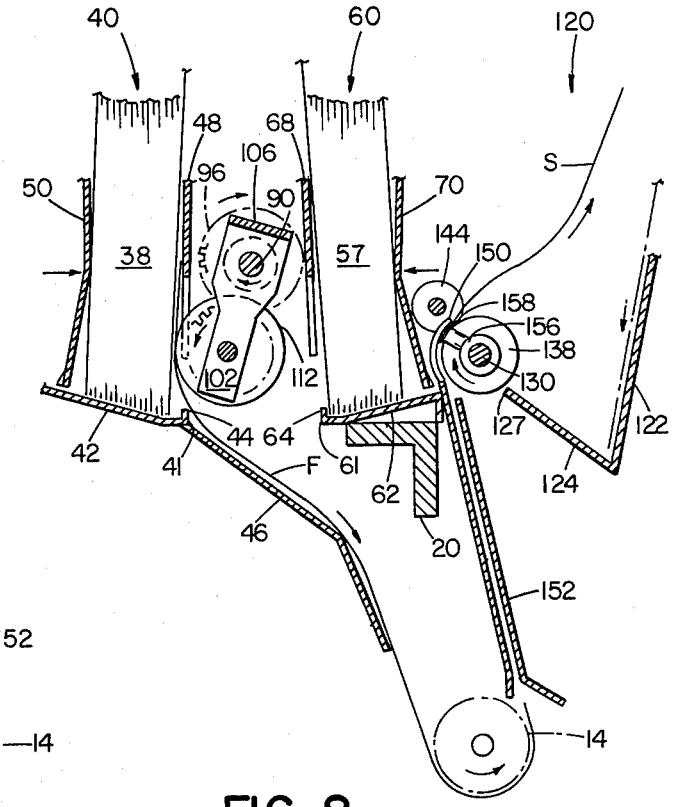

More specifically, rear sheet feeding hopper 40 has a bottom wall 42 with an inner edge 41 and an outer edge 43 for supporting the bottom edge of a stack of paper sheets. Inner edge 41 has on opposite ends thereof mounted on side plates 30 and 32 a pair of abutments 44 for normally retaining the innermost sheet of said stack of sheets thereon. Inner edge 41 is also provided with a central guide plate 46 which extends downwardly and forwardly to guide an ejected sheet of paper F to the rear side of platen 14 of printer 10 for feeding thereto, as shown in FIGS. 7 and 8. A generally vertical inner wall 48 extends between side plates 30 and 32 and is pivotally mounted thereon adjacent its upper end for swinging movement about a horizontal pivot axis 49 for generally horizontal movement of its lower edge from an operating position adjacent inner edge 41 of bottom wall 42 to a loading position within said inner edge to ensure that the sheets of paper will all be retained by bottom wall 42 during loading. A generally vertical outer wall 50, spaced outwardly and rearwardly of inner wall 48, also extends between side plates 30 and 32 and is pivotally mounted thereon adjacent its upper end for swinging movement about a horizontal pivot axis 51 outwardly and rearwardly spaced from the pivot axis 49 of inner wall 48 for generally horizontal movement of its lower edge from an operating position outwardly and rearwardly of inner wall 48 to a loading position more remote from the inner edge 41 of bottom wall 42 in order to provide free access to hopper 40 during loading. Springs 52 extending between outer wall 50 and side plates 30 and 32 normally urge outer wall 50 toward inner wall 48 to compress the stack of paper 38 therebetween.

Front sheet feeding hopper 60 is arranged in mirror image relationship to rear sheet feeding hopper 40. Similarly to it, as partly shown in FIG. 6, front sheet feeding hopper 60 has a bottom wall 62 with an inner edge 61 and an outer edge 63 for supporting the bottom edge of a stack of paper sheets. Inner edge 61 has on opposite ends thereof mounted on side plates 30 and 32 a pair of abutments 64 for normally retaining the innermost sheet of said stack of sheets thereon. Central guide plate 46, which extends downwardly and forwardly spaced beneath inner edge 61, functions to guide an ejected sheet of paper F to the rear side of platen 14 of printed 10 for feeding thereto, as shown in FIGS. 7 and 8. A generally vertical inner wall 68 extends between side plates 30 and 32 and is pivotally mounted thereon adjacent its upper end for swinging movement about a horizontal pivot axis 69 for generally horizontal movement of its lower edge from an operating position adjacent inner edge 61 of bottom wall 62 to a loading position within said inner edge to ensure that the sheets of paper will all be retained by bottom wall 62 during loading. A generally vertical outer wall 70, spaced outwardly and forwardly of inner wall 68, also extends between side plates 30 and 32 and is pivotally mounted thereon adjacent its upper end for swinging movement about a horizontal pivot axis 71 outwardly and forwardly spaced from the pivot axis 69 of inner wall 68 for generally horizontal movement of its lower edge from an operating position outwardly and forwardly of inner wall 68 to a loading position more remote from the inner edge 61 of bottom wall 62 in order to provide free access to hopper 60 during loading. Springs 52 extending between outer wall 70 and end plates 30 and 32 normally urge outer wall 70 toward inner wall 68 to compress the stack of paper 57 therebetween. Inner walls 48 and 68 are normally urged toward their operating position by springs 54 extending therebetween.

Figure 2:
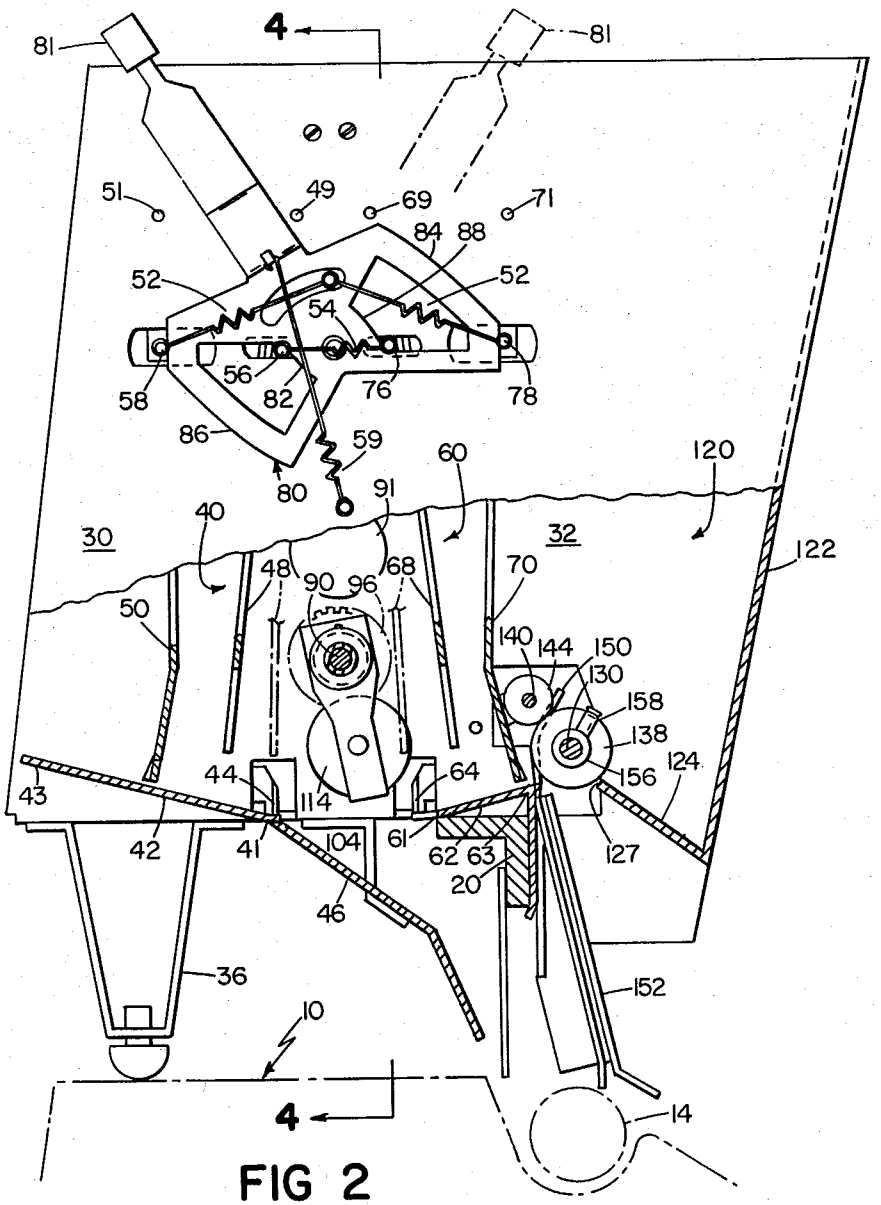
FIG. 2 is a end view, partly broken away and in section, of the mechanism of FIG. 1.

Positioning mechanism, as best shown in FIGS. 1 and 2, is provided for moving the hopper walls between their operating and loading positions. To this end, a manually operable cam plate 80, having an operating lever 81 for moving it between its operating and loading positions, is pivotally mounted on side plate 30. Four cam surfaces are provided on cam plate 80. Opposed inner cam surfaces 82 and 88 are engaged by cam followers 56 and 76 mounted on inner walls 48 and 68, respectively. Opposed outer cam surfaces 86 and 84 are engaged by cam followers 58 and 78 mounted on outer walls 50 and 70, respectively. A spring 59 extending between cam plate 80 and side plate 30 is provided to maintain cam plate 80 in its selected position. In FIG. 2, cam plate 80 and inner walls 48 and 68 are shown in loading position, with lever 81 and walls 48 and 68 shown dotted in operating position.

The extracting mechanism, as best shown in FIGS. 2 through 8, is mounted on side plates 30 and 32 between inner walls 48 and 68 of opposed hoppers 40 and 60 for selectively extracting individual sheets F from either of the hoppers. It includes a drive shaft 90 rotatably mounted in suitable bearings in side plates 30 and 32 and extending between inner walls 48 and 68 for rotation about an axis parallel thereto. Drive shaft 90 is driven by reversible motor 91 through gears 92 and 93 for selectively rotating it in opposite directions. Drive shaft 90 has mounted thereon adjacent one of its ends a driving gear 96 having on one side thereof a radially extending friction surface 98. Adjacent its other end, axially spaced from friction surface 98, drive shaft 90 has an abutment 100 mounted thereon.

A pair of axially spaced rocker arms 102 and 104, having radially extending outer surfaces 103 and 105, respectively, and a connecting element 106, and rockably mounted on drive shaft 90 for axial movement therealong between driving gear outer surface 98 and abutment 100. A friction washer 108 is interposed between driving gear friction surface 98 and rocker arm surface 105. A compression spring 118 is interposed between abutment 100 and rocker arm outer surface 103 to press together rocker arm outer surface 105, friction washer 108 and driving gear friction surface 98 for frictional engagement thereof.

Sheet engaging roll shaft 110 is rotatably mounted on rocker arms 102 and 104 for rotation about an axis spaced from and parallel to the axis of drive shaft 90 and has a pair of axially spaced sheet engaging rolls 112 and 114 mounted thereon. Shaft 110 and rolls 112 and 114 are driven by driving gear 96 through driven gear 116 mounted on shaft 110. Driven gear 116 tangentially engages driving gear 96 in each of the selected operating positions of rocker arms 102 and 104. Also, the surfaces of the sheet engaging rolls 112 and 114 are normally generally tangent in operating position to a selected one of the inner walls 48 and 68.

In order to select the operating position of roll shaft 110 and sheet engaging rolls 112 and 114 to feed sheets F either from hopper 40 (FIG. 8) or hopper 60 (FIG. 7), it is only necessary to select the appropriate direction of rotation of motor 91 by reversing the polarity of its input voltage. By reason of the friction created between the surface 98 of driving gear 96 and the surface 105 of rocker arm 102 through friction washer 108, rocker arms 102 and 104 will rock in the direction of rotation of drive shaft 90 to selectively engage the sheet engaging rolls 112 and 114 with the selected one of the opposed stacks of paper sheets in either hopper 40 or 60 and extract an individual sheet F therefrom for feeding to the platen 14 of printer 10.

The sheet stacking mechanism of the invention for sequentially stacking individual sheets delivered by platen 14 of printer 10 into hopper 120 is best shown in FIGS. 2, 3, 5, 6 and 8. It has a stacking hopper 120 having a generally vertical, upwardly and forwardly sloping forward wall 122 and an upwardly and rearwardly sloping bottom end wall 124 having a rear edge 127, all mounted on side plates 30 and 32. It also includes a drive shaft 130 rotatably mounted on end supporting plates 22 and 24 and extending therebetween parallel and adjacent to rear edge 127 of hopper bottom end wall 124.

For driving shaft 130 from platen shaft 12 of printer 10, a driven gear 132 is mounted on end supporting plate 22 for engagement with platen shaft gear 16. Driven gear 132 drives shaft 130 through timing belt 134. A pair of axially spaced sheet engaging driving rolls 136 and 138 are mounted for rotation with driving shaft 130 within hopper 120 adjacent rear edge 127. A pair of cooperating pressure rolls 142 and 144 are mounted on shaft 140, said pressure rolls tangentially contacting driving rolls 136 and 138 forming a nip therebetween for feeding individual sheets S delivered from platen 14 of printer 10. Shaft 140 is mounted on side plates 30 and 32 by pivotally mounted arms 146 and 148 having springs 147 for urging pressure rolls 142 and 144 into contact with driving rolls 136 and 138.

Preferably, the tangential plane at the point of tangential contact between pressure rolls 142 and 144 and driving rolls 136 and 138 intersects front wall 122 of stacking hopper at an acute angle of between about 35 to 40 degrees.

For guiding the paper sheet S fed from platen 14 to the nip of rolls 142, 144, 136 and 138, a pair of sheet edge guides 152 are provided mounted on side plates 30 and 32, as well as central leading edge guides 150.

For engaging the trailing edge of an individual paper sheet S for positively feeding it into stacking hopper 120, a pusher element 156 is mounted on drive shaft 130 for rotation therewith generally centrally between driving rolls 136 and 138. Element 156 has a sheet edge receiving groove 158 spaced from the axis of drive shaft 130 at a radius generally equal to the radius of driving rolls 136 and 138. Thus, as best seen in FIG. 8, after driving rolls 136 and 138 have rotated sufficiently to move the trailing edge of a sheet S through their nip, further rotation of driving shaft 130 will engage groove 158 with said trailing edge and continue to move the sheet S toward the front wall of hopper 120 for proper stacking of sheets in sequence as they are delivered from printer 10.

In a commercial embodiment of the dual feeding and stacking mechanism of the invention, used with a printer in a word processing system, stacks of 200 sheets of paper are loaded into feeding hoppers 40 and 60, with, for example, letterheads in feeding hopper 40 and second sheets in feeding hopper 60, for the production of two page letters which, after printing, are automatically stacked in sequence in stacking hopper 120.

What is claimed is:

1. A dual sheet feeder for a printer or the like, comprising a supporting frame a pair of opposed sheet hoppers mounted on said frame for supporting opposed stacks of paper sheets and extracting means mounted on said frame between said hoppers for selectively extracting sheets from either of said hoppers, said extracting means having a drive shaft mounted on said frame between said hoppers for rotation about an axis parallel to said hoppers reversible power means for selectively rotating said drive shaft in opposite directions rocker arm means rockably mounted on said drive shaft sheet engaging roll means rotatably mounted on said rocker arm means for rotation about an axis spaced from and parallel to the axis of said drive shaft sheet engaging roll driving means mounted on said drive shaft for rotating said sheet engaging roll and friction means interposed between said arm and said drive shaft for rocking said arm in the direction of rotation of said drive shaft to selectively engage said sheet engaging roll means responsive to the direction of rotation of said drive shaft with one of said opposed stacks of paper sheets and extract an individual sheet therefrom.

2. A dual sheet feeder as claimed in claim 1, wherein said friction means includes radially extending surfaces on said arm and said shaft and spring means urging said surfaces together in a direction axially of said shaft.

3. A dual sheet feeder as claimed in claim 2, wherein said sheet engaging roll driving means includes gear means rigidly mounted on said drive shaft and having a radially extending surface said rocker arm means is mounted on said drive shaft for axial movement therealong and has a radially extending surface, and said spring means urges said surfaces together.

4. A dual sheet feeder as claimed in claim 3, wherein said friction means further includes abutment means on said drive shaft and said spring means comprises compression spring means interposed between said abutment means and said rocker arm means.

5. A dual sheet feeder as claimed in claim 1, wherein said sheet feeding hoppers include bottom wall means for supporting thereon the bottom edge of a stack of paper sheets, said bottom wall having an inner edge spaced below the surface of said sheet engaging roll means generally vertical inner wall means having its lower edge in an operating position adjacent said inner edge of said bottom wall generally vertical outer wall means horizontally outwardly spaced from said inner wall means and mounted on said frame for generally horizontal movement of its lower edge toward and away said inner wall means, and spring means for normally urging said outer wall means toward said inner wall means.

6. A dual sheet feeder as claimed in claim 5, wherein said inner wall means is mounted on said frame for generally horizontal movement of its lower edge from an operating position adjacent said inner edge of said bottom wall means to a loading position more remote from said inner edge said generally vertical outer wall means is mounted on said frame for generally horizontal movement of its lower edge from an operating position outward of said inner wall means to a loading position more remote from said inner wall means, and positioning means are provided for moving said inner and outer wall means between their operating and loading positions.

7. A dual sheet feeder as claimed in claim 6, wherein said positioning means includes cam means pivotally mounted on said frame and follower means mounted on said inner and outer wall means.

8. A dual sheet feeder as claimed in claim 7, wherein said inner and outer wall means are pivotally mounted adjacent their upper ends for movement about spaced horizontal axes.

9. A dual sheet feeder for a printer or the like, comprising a supporting frame a pair of opposed sheet feeding hoppers mounted on said frame for supporting opposed stacks of paper sheets, said sheet feeding hoppers including bottom wall means for supporting thereon the bottom edge of a stack of paper sheets, said bottom wall means having inner and outer edges generally vertical inner wall means pivotally mounted on said frame adjacent its upper end for swinging movement about a horizontal axis for generally horizontal movement of its lower edge from an operating position adjacent said inner edge of said bottom wall means to a loading position within said inner edge generally vertical outer wall means pivotally mounted on said frame adjacent its upper edge for swinging movement about a horizontal axis outwardly spaced from the axis of said inner wall means for generally horizontal movement of its lower edge from an operating position outward of said inner wall means to a loading position more remote from said inner edge means normally urging said outer wall means toward said inner wall means to compress said stack of paper therebetween, and positioning means for moving said inner and outer wall means between their operating and loading positions extracting means mounted on said frame between the inner wall means of said opposed hoppers for selectively extracting individual sheets from either of said hoppers, said extracting means having a drive shaft rotatably mounted on said frame and extending between said opposed inner wall means for rotation about an axis parallel thereto, said drive shaft having mounted thereon a driving gear having a radially extending surface reversible power means for selectively rotating said drive shaft in opposite directions rocker arm means having a radially extending surface rockably mounted on said drive shaft sheet engaging roll means rotatably mounted on said rocker arm means for rotation about a axis spaced from and parallel to the axis of said drive shaft, the surface of said sheet engaging roll means being normally generally tangent in operating position to a selected one of said inner wall means, said sheet engaging roll means having a driven gear thereon tangentially engaging said drive shaft driving gear in both of its selected operating positions, and friction means interposed between said radially extending surfaces of said arm means and said driving gear for rocking said arm means in the direction of rotation of said drive shaft to selectively engage said sheet engaging roll means responsive to the direction of rotation of said drive shaft with one of said opposed stacks of paper sheets and extract an individual sheet therefrom.

10. A dual sheet feeder as claimed in claim 9, wherein said positioning means includes cam means pivotally mounted on said frame and follower means mounted on said inner and outer wall means.

11. A dual sheet feeder as claimed in claim 10, wherein said cam means has a manually operable lever for moving it between said operating and loading positions.

12. A dual sheet feeder for a printer or the like, comprising a supporting frame a pair of opposed sheet feeding hoppers mounted on said frame for supporting opposed stacks of paper sheets, said sheet feeding hoppers including bottom wall means for supporting thereon the bottom edge of a stack of paper sheets, said bottom wall means having inner and outer edges generally vertical inner wall means pivotally mounted on said frame adjacent its upper end for swinging movement about a horizontal axis for generally horizontal movement of its lower edge from an operating position adjacent said inner edge of said bottom wall means to a loading position within said inner edge generally vertical outer wall means pivotally mounted on said frame adjacent its upper edge for swinging movement about a horizontal axis outwardly spaced from the axis of said inner wall means for generally horizontal movement of its lower edge from an operating position outward of said inner wall means to a loading position more remote from said inner edge spring means normally urging said outer wall means toward said inner wall means to compress said stack of paper therebetween positioning means for moving said inner and outer wall means between their operating and loading positions, including cam means pivotally mounted on said frame and follower means mounted on said inner and outer wall means, said cam means having a manually operable lever for moving said wall means between said operating and loading positions extracting means mounted on said frame between said opposed inner wall means of said opposed hoppers for selectively extracting individual sheets from either of said hoppers, said extracting means having a drive shaft rotatably mounted on said frame and extending between said inner wall means for rotation about an axis parallel thereto, said drive shaft having mounted thereon and axially spaced from one another a driving gear having a radially extending surface and an abutment reversible power means for selectively rotating said drive shaft in opposite directions rocker arm means having a radially extending surface rockably mounted on said drive shaft between said driving gear and said abutment for axial movement therealong sheet engaging roll means rotatably mounted on said rocker arm means for rotation about a axis spaced from and parallel to the axis of said drive shaft, the surface of said sheet engaging roll means being normally generally tangent in operating position to a selected one of said inner wall means, said sheet engaging roll means having a driven gear thereon tangentially engaging said drive shaft driving gear in both of its selected operating positions friction means interposed between said radially extending surfaces of said arm means and said driving gear, and compression spring means interposed between said abutment and said arm means for urging said surfaces together in a direction axially of said shaft for rocking said arm means in the direction of rotation of said drive shaft to selectively engage said sheet engaging roll means responsive to the direction of rotation of said drive shaft with one of said opposed stacks of paper sheets and extract an individual sheet therefrom.

13. A sheet feeder for a printer or the like, comprising a supporting frame a sheet feeding hopper mounted on said frame for supporting a stack of paper sheets and extracting means mounted on said frame for extracting individual sheets from said hopper, said sheet feeding hopper including bottom wall means for supporting thereon the bottom edge of a stack of paper sheets, said bottom wall means having inner and outer edges generally vertical inner wall means pivotally mounted on said frame adjacent its upper end for swinging movement about a horizontal axis for generally horizontal movement of its lower edge from an operating position adjacent said inner edge of said bottom wall means to a loading position within said inner edge generally vertical outer wall means pivotally mounted on said frame adjacent its upper edge for swinging movement about a horizontal axis outwardly spaced from the axis of said inner wall means for generally horizontal movement of its lower edge from an operating position outward of said inner wall means to a loading position more remote from said inner edge spring means normally urging said outer wall means toward said inner wall means to compress said stack of paper therebetween positioning means for moving said inner and outer wall means between their operating and loading positions, including cam means pivotally mounted on said frame and follower means mounted on said inner and outer wall means, said cam means having a manually operable lever for moving said wall means between said operating and loading positions.

14. A dual sheet feeder as claimed in claim 1, further including a sheet stacker, comprising a sheet receiving hopper having a forward wall and a bottom end wall extending rearwardly therefrom, and stacking means for feeding individual sheets into said sheet receiving hopper, comprising nip roll means mounted on said frame adjacent the rear edge of said bottom end wall of said sheet receiving hopper, said nip roll means including tangentially contacting roll surfaces for feeding individual sheets therebetween and pusher means for engaging the trailing edge of a paper sheet for feeding it into said stacking hopper.

15. A sheet stacker as claimed in claim 14, wherein said pusher means moves said trailing edge toward said forward side wall after it passes said tangentially contacting roll surfaces.

16. A dual sheet feeder as claimed in claim 13, further including a sheet stacker, comprising a sheet receiving hopper having a generally vertical upwardly and forwardly sloping forward side wall and an upwardly and rearwardly sloping bottom end wall extending rearwardly therefrom and having a rear edge, and stacking means for sequentially feeding individual sheets into said sheet receiving hopper, comprising a drive shaft rotatably mounted on said frame extending parallel and adjacent to said rear edge sheet engaging driving roll means mounted on said drive shaft pressure roll means mounted on said frame, said pressure roll means tangentially contacting said driving roll means forming a nip therebetween for feeding individual sheets therebetween, and pusher means mounted on said shaft for rotation therewith for engaging the trailing edge of an individual paper sheet for aiding its feeding into said stacking hopper, said pusher means having a sheet edge receiving groove spaced from the axis of said shaft at a radius generally equal to the radius of said driving roll means for receiving said trailing edge and moving it toward said forward wall after it leaves the nip of said roll means.

17. A sheet stacker as claimed in claim 16, wherein the tangential plane at the point of tangential contact of said roll means intersects said forward wall at an acute angle of between about 35 to 40 degrees.

* * * * *